US010519914B2

(12) United States Patent
Fitzner et al.

(10) Patent No.: US 10,519,914 B2
(45) Date of Patent: Dec. 31, 2019

(54) FUEL INJECTION SYSTEM AND METHOD OF OPERATING A FUEL INJECTION SYSTEM

(71) Applicants: Hyundai Motor Company, Seoul (KR); Kia Motors Corporation, Seoul (KR)

(72) Inventors: Stephan Fitzner, Langen (DE); Stephan Kolk, Rockenberg (DE)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 125 days.

(21) Appl. No.: 15/934,605

(22) Filed: Mar. 23, 2018

(65) Prior Publication Data

US 2019/0162146 A1 May 30, 2019

(30) Foreign Application Priority Data

Nov. 27, 2017 (DE) ..... 10 2017 221 203

(51) Int. Cl.

| | |
|---|---|
| ***F02M 61/14*** | (2006.01) |
| ***F02F 1/42*** | (2006.01) |
| ***F02M 61/18*** | (2006.01) |
| ***F02M 61/16*** | (2006.01) |
| ***F02M 35/10*** | (2006.01) |
| ***F02M 69/04*** | (2006.01) |

(52) U.S. Cl.

CPC ..... *F02M 61/14* (2013.01); *F02F 1/42* (2013.01); *F02M 35/10301* (2013.01); *F02M 61/168* (2013.01); *F02M 61/1806* (2013.01); *F02M 69/045* (2013.01); *F02M 35/10216* (2013.01); *F02M 2200/851* (2013.01); *F02M 2200/858* (2013.01)

(58) Field of Classification Search

CPC .... F02M 61/14; F02M 61/168; F02M 69/045; F02M 2200/851; F02M 2200/858

See application file for complete search history.

(56) References Cited

U.S. PATENT DOCUMENTS 3,038,456 A * 6/1962 Dreisin ..... F02M 61/14 123/470
3,325,104 A * 6/1967 Roosa ..... F02M 55/005 239/584
3,857,573 A * 12/1974 Pugh ..... F02M 61/145 277/598

(Continued)

FOREIGN PATENT DOCUMENTS

DE 100 38 763 A1 2/2002
DE 10 2008 002 654 A1 12/2009

(Continued)

*Primary Examiner* — Thomas N Moulis

(74) *Attorney, Agent, or Firm* — Morgan, Lewis & Bockius LLP

(57) ABSTRACT

A fuel injection system for an engine of a vehicle may include an injector nozzle mounted in an injector bore formed in a cylinder head of the engine, wherein a tip portion of the injector nozzle is protrudingly formed into a combustion chamber, and having a positioning system configured to adjust an axial position of the injector nozzle in the injector bore. The invention further provides a method of operating the fuel injection system.

17 Claims, 11 Drawing Sheets

(56) References Cited

U.S. PATENT DOCUMENTS 4,286,563 A * 9/1981 Fahim ..... F02B 75/22 123/469
4,293,992 A * 10/1981 Webb ..... B25B 27/0035 29/267
5,048,500 A * 9/1991 Curhan ..... F02M 31/135 123/470
5,718,205 A * 2/1998 Jo ..... F02D 9/1065 123/337
5,785,024 A * 7/1998 Takei ..... F02F 11/00 123/470
5,943,995 A * 8/1999 Niwa ..... F02M 61/14 123/468
6,260,404 B1 * 7/2001 Aota ..... F02M 51/061 73/1.36
6,289,876 B1 * 9/2001 Mackert ..... F02M 57/025 123/470
6,295,969 B1 * 10/2001 Kato ..... F02B 61/045 123/41.31
6,427,667 B1 * 8/2002 Kato ..... F02B 61/045 123/295
6,431,151 B1 * 8/2002 Gmelin ..... F02M 61/14 123/468
7,334,571 B1 * 2/2008 Beardmore ..... F02M 61/14 123/456
7,429,007 B2 * 9/2008 Luft ..... F02M 51/0671 239/585.1
7,444,992 B2 * 11/2008 Ricci ..... F02M 61/14 123/470
7,543,567 B2 * 6/2009 Gibson ..... F02M 55/005 123/456
8,939,019 B2 * 1/2015 Kordass ..... F02M 65/00 73/114.45
9,664,160 B2 5/2017 Park et al.
9,726,130 B2 * 8/2017 Karay ..... F02M 21/0266
9,863,384 B1 * 1/2018 Eves ..... F02F 1/004
2001/0037796 A1 * 11/2001 Lorraine ..... F02M 55/005 123/470
2002/0157648 A1 * 10/2002 Reiter ..... F02M 61/14 123/470
2003/0094513 A1 * 5/2003 Luft ..... F02M 51/0671 239/533.9
2004/0232259 A1 * 11/2004 Kienzler ..... F02M 61/167 239/533.2
2006/0243254 A1 * 11/2006 Yahara ..... F02M 55/02 123/470
2012/0247426 A1 * 10/2012 Roseborsky ..... F02M 61/14 123/470
2013/0291631 A1 * 11/2013 Kordass ..... F02M 65/00 73/116.01
2013/0333669 A1 * 12/2013 Kromer ..... F02M 55/005 123/456
2014/0123933 A1 * 5/2014 Okamoto ..... F02M 51/0671 123/294
2014/0261332 A1 * 9/2014 Ramamurthy ..... F02M 61/14 123/470
2015/0060573 A1 3/2015 Mechi et al.
2017/0138325 A1 * 5/2017 Roseborsky ..... F02M 55/025
2018/0141251 A1 * 5/2018 Yano ..... B29C 45/5008
2019/0255664 A1 * 8/2019 Lukasik ..... B23P 6/04

FOREIGN PATENT DOCUMENTS

JP 3033499 B2 4/2000
JP 2013-174287 A 9/2013
KR 10-2003-0016963 A 3/2003

* cited by examiner

FUEL INJECTION SYSTEM AND METHOD OF OPERATING A FUEL INJECTION SYSTEM

CROSS-REFERENCE TO RELATED APPLICATION

The present application claims priority to German Patent Application No. 102017221203.9, filed on Nov. 27, 2017, the entire contents of which is incorporated herein for all purposes by this reference.

BACKGROUND OF THE INVENTION

Field of the Invention

The present invention relates to a fuel injection system for an internal combustion engine of a vehicle. Furthermore, the present invention relates to a method of operating a fuel injection system for an internal combustion engine of a vehicle.

Description of Related Art

Generally, a fuel injection system plays a major role for the combustion of an internal combustion engine. Within the combustion chamber, the correlation of the injector nozzle to the piston bowl layout is the main driver for a clean and efficient combustion.

In state of the art direct injection engines, the injector is mounted into the injector bore with a washer at the bottom end portion. The tip portion of the injector nozzle extends into the combustion chamber with a fixed protrusion. The injector position and therefore the piston bowl to nozzle layout is defined by selecting a defined washer thickness. The finally chosen injector position has to be usable at maximum power and high speeds as well as at low-end speeds and low loads and is not variable during engine operation. At the end portion, the chosen injector position is always a compromise and does not match the best injector position for every engine operation point.

U.S. Pat. No. 9,664,160 B2 may include a vehicular high pressure direct injection type injector having a valve seat body for fuel-atomization. A nozzle hole has an elliptical cross-section so that the fuel injection speed can be increased, whereby a fuel atomization effect can be maximized.

Consequently, there is a need to further improve a fuel injection system as well as a corresponding fuel injection method.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a fuel injection system for an internal combustion engine of a vehicle and a method of operating a fuel injection system for an internal combustion engine of a vehicle.

Various aspects of the present invention are directed to providing a fuel injection system for an internal combustion engine of a vehicle.

The fuel injection system may include an injector nozzle mounted in an injector bore formed in a cylinder head of the internal combustion engine, wherein a tip portion of the injector nozzle protrudes into a combustion chamber.

The fuel injection system may further include a positioning system configured to adjust an axial position of the injector nozzle in the injector bore.

The positioning system may include a tensioner device configured to apply a first axial force to the injector nozzle directed in a first axial direction thereof.

The positioning system may include an adjusting device configured to apply a second axial force to the injector nozzle, the second axial force being directed in an opposite direction than the first axial force, and wherein the adjusting device is configured to vary the second axial force applied to the injector nozzle, wherein the axial position of the injector nozzle in the injector bore is adjustable to a predetermined position within a range of predetermined positions.

Various aspects of the present invention are directed to providing a method of operating a fuel injection system for an internal combustion engine of a vehicle.

The method may include providing an injector nozzle mounted in an injector bore formed in a cylinder head of the internal combustion engine, wherein a tip portion of the injector nozzle protrudes into a combustion chamber and providing a positioning system for adjusting an axial position of the injector nozzle in the injector bore.

The method may further include applying a first axial force to the injector nozzle directed in a first axial direction by a tensioner device.

The method moreover may include applying a second axial force to the injector nozzle directed in a second axial direction by an adjusting device, the second axial force being directed in an opposite direction than the first axial force.

The method additionally may include varying the second axial force applied to the injector nozzle, wherein the axial position of the injector nozzle in the injector bore is adjusted to a predetermined position within a range of predetermined positions.

Various aspects of the present invention are directed to providing a vehicle having an internal combustion engine and a fuel injection system as herein described.

The idea of the present invention is directed to providing a fuel injection system having a positioning system configured for adjusting an axial position of the injector nozzle in the injector bore thus effectively achieving an optimal injector position, especially an optimized position of an injector tip in the combustion chamber in a plurality of operating states of the internal combustion engine. As such, the engine efficiency and particle emissions can be improved. By positioning the injector nozzle at an optimized position depending on engine speed and load, the aforementioned advantageous characteristics can be achieved.

Moreover, the positioning system for the fuel injection system according to an exemplary embodiment of the present invention is not linked to a specific injection system of a manufacturer, thus facilitating usage of the positioning system with all injection systems. The positioning system according to an exemplary embodiment of the present invention can be integrated into an existing layout in a simple manner, wherein only small adjustments of cylinder head and/or the injector are needed.

Various aspects of the present invention are directed to providing an additional degree of freedom by providing the possibility to choose an adjusting method in accordance to provided construction boundaries of the fuel injection system.

According to an exemplary embodiment of the present invention, the first axial force applied to the injector nozzle by the tensioner device and the second axial force applied to the injector nozzle by the adjusting device are substantially equal in magnitude. This advantageously has an effect that the force being applied to the injector nozzle is substantially constant over the complete engine cycle. This in turn keeps precise fuel injection capability of the injector nozzle due to no force imbalance being applied to it and has no negative impact on fuel injection quality.

According to another exemplary embodiment of the present invention, a distance of the tip portion of the injector nozzle protruding into the combustion chamber is adjustable to a predetermined position within a range of predetermined positions by adjusting the axial position of the injector nozzle in the injector bore. In doing so, an optimal position of the tip portion of the injector nozzle can be realized for all operating points of the internal combustion engine.

According to another exemplary embodiment of the present invention, the tensioner device may include a spring element which is connected to the injector nozzle such that a spring force of the spring element is converted into the first axial force directed in the first axial direction applied to the injector nozzle. Providing the spring element thus effectively spring loads the injector nozzle such that it is securely held in the injector bore.

According to another exemplary embodiment of the present invention, the tensioner device may further include a rocker lever, an injector mounting element and an injector clamping element, wherein the spring element is disposed substantially in parallel to the injector nozzle and applies a spring force to a first side of the rocker lever, the rocker lever being held between the injector mounting element disposed at a second side of the rocker lever, the injector mounting element being mounted to the cylinder head, and the injector clamping element disposed at the first side of the rocker lever adjacent to the spring element, the injector clamping element being clamped to the injector nozzle at a predetermined axial position.

By providing the injector mounting element, an upper limit for movement of the injector nozzle can be provided, wherein the rocker lever is advantageously supported by the injector mounting element such that the rocker lever can apply a force on the injector clamping element which is directed in the first axial direction thereof, i.e. downward towards the combustion chamber.

According to another exemplary embodiment of the present invention, the spring element is configured to tilt the rocker lever such that the rocker lever applies an axial force to the injector clamping element, the injector clamping element being configured to adjust an axial position of the injector nozzle in the injector bore. Due to the rocker lever being held between the injector mounting element and the injector clamping element, the spring force applied to the rocker lever can be effectively converted into an axial movement of the injector nozzle by the rocker lever applying the force to the injector clamping element.

According to another exemplary embodiment of the present invention, the adjusting device may include a first flexible gasket disposed at an axial end portion of the injector bore adjacent to the combustion chamber, wherein the first flexible gasket fluidically communicates with a fluid supply, and wherein the first flexible gasket is configured such that a thickness of the first flexible gasket in an axial direction of the injector nozzle is adjustable by adjusting a fluid pressure supplied to the first flexible gasket.

The first flexible gasket is thus configured for adjusting its thickness in reaction to a change in fluid pressure supplied to the first flexible gasket from the fluid supply thus being configured for achieving very fast rates of adjustment of the position of the injector nozzle as required during operation of the internal combustion engine.

According to another exemplary embodiment of the present invention, the first flexible gasket is configured to vary the second axial force applied to the injector nozzle, wherein the axial position of the injector nozzle in the injector bore is adjustable by the first flexible gasket to the predetermined position within the range of predetermined positions as a function of the thickness of the first flexible gasket. The first flexible gasket in varying the second axial force which is a counterforce to the first axial force provided by the spring element can thus be precisely adjusted such that a respective position of the injector nozzle can be set.

According to another exemplary embodiment of the present invention, the tensioner device may include a second flexible gasket disposed at an axial end portion of the injector bore adjacent to the combustion chamber, wherein the second flexible gasket is filled with a fluid, and wherein the second flexible gasket is configured to apply the second axial force to the injector nozzle directed in a second axial direction thereof. Due to the second flexible gasket being filled with fluid while retaining a certain degree of flexibility, it enables to apply the second axial force to the injector nozzle directed in the second axial direction against the first axial force provided by the piston arrangement.

According to another exemplary embodiment of the present invention, the second flexible gasket is configured to apply the second axial force in the second axial direction as a function of a thickness of the second flexible gasket in the axial direction of the injector nozzle. A first axial force provided by a piston arrangement thus is required to increase to reduce a thickness of the flexible gasket, i.e. The flexible gasket providing a counterforce that increases as a function of a reduction in thickness of the flexible gasket.

According to another exemplary embodiment of the present invention, the adjusting device may include a piston arrangement which is connected to the injector nozzle such that a piston movement of the piston arrangement is converted into the first axial force directed in the first axial direction applied to the injector nozzle. Providing the piston arrangement thus effectively puts an axial force on the injector nozzle such that it is securely held in the injector bore.

According to another exemplary embodiment of the present invention, the piston arrangement of the adjusting device may include a piston rod, a first axial end portion of which is connected to a piston disposed in a chamber which fluidically communicates with a fluid supply, and a second axial end portion of which abuts a rocker lever, wherein the piston rod is disposed substantially in parallel to the injector nozzle and is configured to apply a force to a first side of the rocker lever, the rocker lever being held between an injector mounting element disposed at a second side of the rocker lever, the injector mounting element being mounted to the cylinder head, and an injector clamping element disposed at the first side of the rocker lever adjacent to the piston rod, the injector clamping element being clamped to the injector nozzle at a predetermined axial position.

By providing the injector mounting element, an upper limit for movement of the injector nozzle can be provided, wherein the rocker lever is advantageously supported by the injector mounting element such that the rocker lever can apply a force on the injector clamping element which is directed in the first axial direction thereof, i.e. downward towards the combustion chamber.

According to another exemplary embodiment of the present invention, the piston rod is configured to tilt the rocker lever such that the rocker lever applies an axial force to the injector clamping element, the injector clamping element being configured to adjust an axial position of the injector nozzle in the injector bore. Due to the rocker lever being held between the injector mounting element and the injector clamping element, the force applied to the rocker lever by the piston arrangement can be effectively converted into an axial movement of the injector nozzle by the rocker lever applying the force to the injector clamping element.

According to another exemplary embodiment of the present invention, the adjusting device is configured to continuously adjust the injector nozzle in the injector bore as a function of predetermined operating parameters of the internal combustion engine including at least one of an engine speed, an engine torque and a fuel injection quantity. By being able to continuously adjust the injector nozzle in the injector bore a maximum efficiency under all engine operating points can be achieved.

The herein described features of the fuel injection system are also included in the method of operating a fuel injection system for an internal combustion engine of a vehicle, the vehicle and vice versa.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

Unless indicated otherwise, like reference numerals or signs to the figures indicate like elements.

Figure 1A:
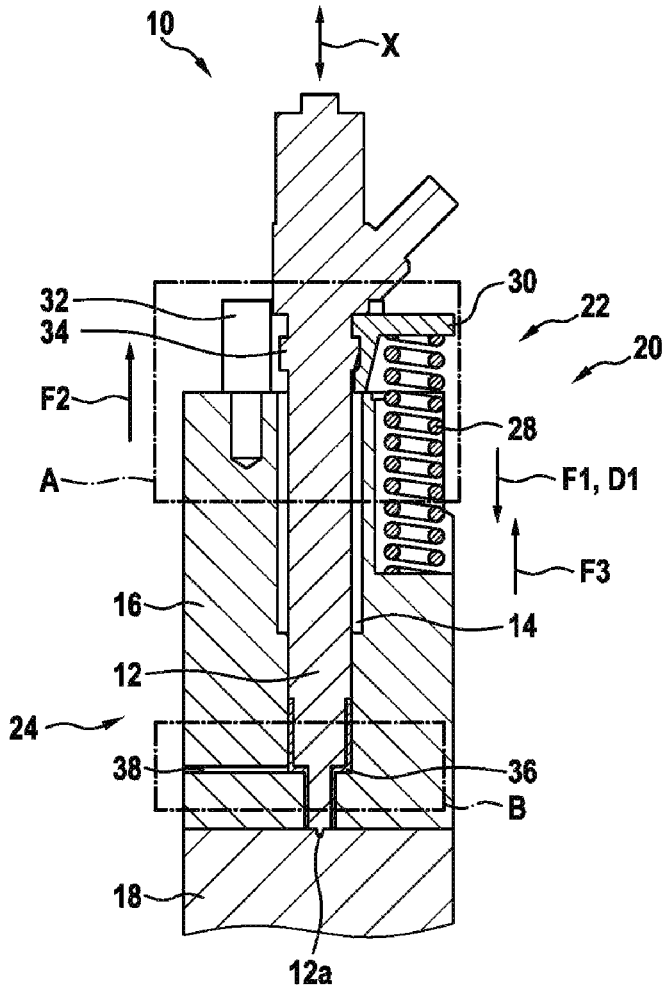
FIG. 1A shows a cross-sectional view of a fuel injection system according to various exemplary embodiments of the invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in portion by the particularly intended application and use environment.

In the figures, reference numbers refer to the same or equivalent parts of the present invention throughout the several figures of the drawing.

DETAILED DESCRIPTION

Reference will now be made more specifically to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the other hand, the invention(s) is/are intended to cover not only the exemplary embodiments, but also various alternatives, modifications, equivalents and other embodiments, which may be included within the spirit and scope of the invention as defined by the appended claims.

FIG. 1 shows a cross-sectional view of a fuel injection system according to various exemplary embodiments of the invention.

The fuel injection system 10 for the internal combustion engine of the vehicle includes an injector nozzle 12 mounted in an injector bore 14 formed in a cylinder head 16 of the internal combustion engine, wherein a tip portion 12*a* of the injector nozzle 12 protrudes into a combustion chamber 18.

A positioning system 20 is configured to adjust an axial position of the injector nozzle 12 in the injector bore 14, wherein the positioning system 20 includes a tensioner device 22 configured to apply a first axial force F1 to the injector nozzle 12 directed in a first axial direction D1.

The positioning system further includes an adjusting device 24 configured to apply a second axial force F2 to the injector nozzle 12, the second axial force F2 being directed in an opposite direction than the first axial force F1, and wherein the adjusting device 24 is configured to vary the second axial force F2 applied to the injector nozzle 12.

The axial position of the injector nozzle 12 in the injector bore is thus adjustable to a predetermined position within a range of predetermined positions.

The first axial force F1 applied to the injector nozzle 12 by the tensioner device 22 and the second axial force F2 applied to the injector nozzle 12 by the adjusting device 24 are substantially equal in magnitude.

The position is measured as a distance of the tip portion 12*a* of the injector nozzle from a top wall of the combustion chamber 18, i.e. the distance that the tip portion 12*a* of the injector nozzle 12 protrudes into the combustion chamber 18. Exemplary distances are e.g., protrusions of 1.0 mm, 1.5 mm and 2.0 mm, wherein a protrusion of 1.0 mm has been chosen to be the most advantageous position for high engine speeds yielding low fuel consumption and low particle emissions. Furthermore, a protrusion of 1.5 mm has been shown to be most advantageous at medium engine speeds e.g., around 2000 RPM wherein likewise low fuel consumption and low particle emissions can be achieved in comparison to other values of protrusions.

Furthermore, it has been shown that a protrusion of 2.0 mm is most advantageous at low engine speeds, e.g., around 1000 RPM, in which lower specific fuel consumption and lower particle emissions can be achieved in comparison to other protrusion positions of the tip portion 12*a* of the injector nozzle 12 into the combustion chamber 18.

The above-mentioned protrusion values are only exemplary and may vary according to parameters including engine displacement, combustion chamber dimensions, e.g., geometry, as well as a geometry of a piston bowl.

Furthermore, the adjusting device 24 is configured to continuously adjust the injector nozzle 12 in the injector bore 14 as a function of predetermined operating parameters of the internal combustion engine including at least one of an engine speed, an engine torque and a fuel injection quantity.

By continuously adjusting the injector nozzle in the injector bore, the protrusion of the tip portion 12*a* of the injector nozzle into the combustion chamber 18 can also be continuously adjusted. The present enables to achieve optimum results as far as specific fuel consumption and particle emissions are concerned. Alternatively, as mentioned before, specific protrusions of the tip portion 12*a* of the injector nozzle 12 into the combustion chamber can be assigned to specific engine speeds, for example, a first protrusion value for low engine speeds, a second protrusion value for medium engine speeds, and a third protrusion value for high engine speeds. The number of specific protrusion values can of course comprise additional values.

A distance 26 of the tip portion 12*a* of the injector nozzle 12 protruding into the combustion chamber 18 is thus adjustable to a predetermined position within a range of predetermined positions by adjusting the axial position of the injector nozzle 12 in the injector bore 14.

The tensioner device 22 includes a spring element 28 which is connected to the injector nozzle 12 such that a spring force F3 of the spring element 28 is converted into the first axial force F1 directed in the first axial direction D1 applied to the injector nozzle 12.

This way, by providing the spring element 28, it is possible to tension, i.e. preload, the injector nozzle 12 in the injector bore 14 such that the injector nozzle 12 is securely held in the injector bore 14 due to the first axial force F1 acting on the injector nozzle 12 in the first axial direction D1.

Figure 1B:
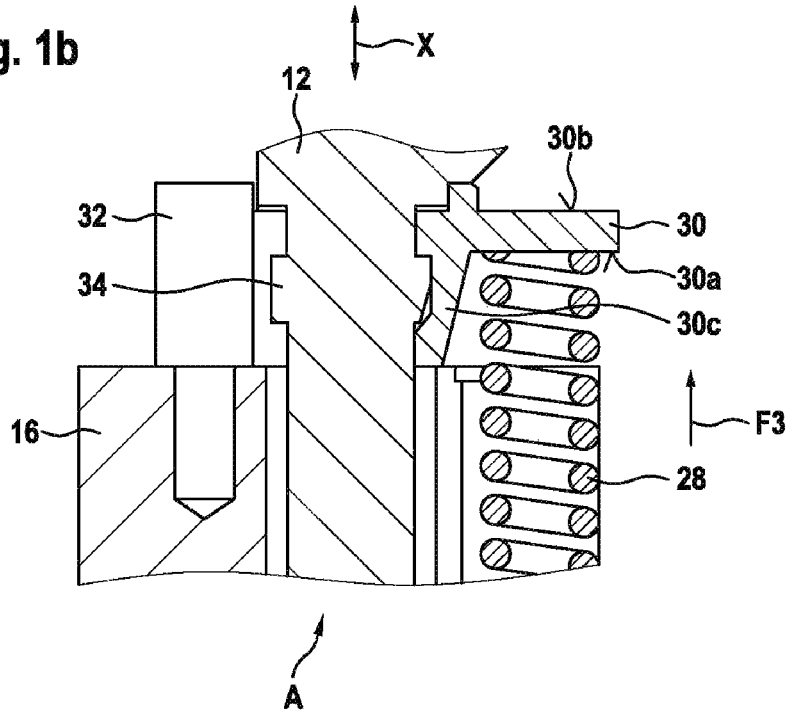
FIG. 1B shows an enlarged cross-sectional view of portion A shown in FIG. 1A of the fuel injection system according to the various exemplary embodiments of the invention.

FIG. 1B shows an enlarged cross-sectional view of portion A shown in FIG. 1A of the fuel injection system according to the various exemplary embodiments of the invention.

The tensioner device 22 further includes a rocker lever 30, an injector mounting element 32 and an injector clamping element 34. The spring element 28 is disposed substantially in parallel to the injector nozzle 12 and applies a spring force F3 to a first side 30*a* of the rocker lever 30. The rocker lever 30 is being held between the injector mounting element 32 disposed at a second side 30*b* of the rocker lever 30. The injector mounting element 32 itself is mounted to the cylinder head 16.

Furthermore, the injector clamping element 34 is disposed at the first side 30*a* of the rocker lever 30 adjacent to the spring element 28, the injector clamping element 34 being clamped to the injector nozzle 12 at a predetermined axial position. The injector clamping element 34 is thus solidly fixed to the injector nozzle 12 at the disposed position.

The spring element 28 is configured to tilt the rocker lever 30 such that the rocker lever 30 applies an axial force to the injector clamping element 34. The injector clamping element 34 is configured to adjust an axial position of the injector nozzle 12 in the injector bore.

This is being achieved by the rocker lever 30 applying the axial force F1 to the injector clamping element 34, the injector clamping element 34 being fixed to the injector nozzle 12 and thus transferring the force F1 applied to the injector clamping element 34 by the rocker lever 30 into an axial movement of the injector nozzle 12.

The rocker lever 30 further includes a restriction element 30*c* which extends from the first side 30*a* of the rocker lever 30 in the first axial direction D1 and is at least partially bent towards the injector nozzle 12 at a predetermined degree to an axial direction X of the injector nozzle 12. The restriction element 30*c* is configured as a lower stop to limit a movement of the injection nozzle 12 in the injector bore 14.

Furthermore, a further stop is defined by the geometry of the rocker lever 30, the rocker lever 30 extending substantially perpendicularly to the axial direction X of the injector nozzle such that it ends in close proximity to the injector nozzle 12.

In the present manner, the stops, i.e. the upper and the lower stop being provided by the geometry of the rocker lever 30, is formed to fully include the injector clamping element 34, thus only allowing movement of the injector clamping element 34 which moves along with movement of the injector nozzle 12 within a predetermined range from the upper stop to the lower stop, thus preventing excessive movement of the injector nozzle in the injector bore in a case of e.g., pressure fluctuations of a pressure fluid applying a pressure on the injector nozzle 12.

By concentrated actuation on the sealing side, a counter force for clamping the injector nozzle 12 is thus covered by the tensioner device 22.

Figure 1C:
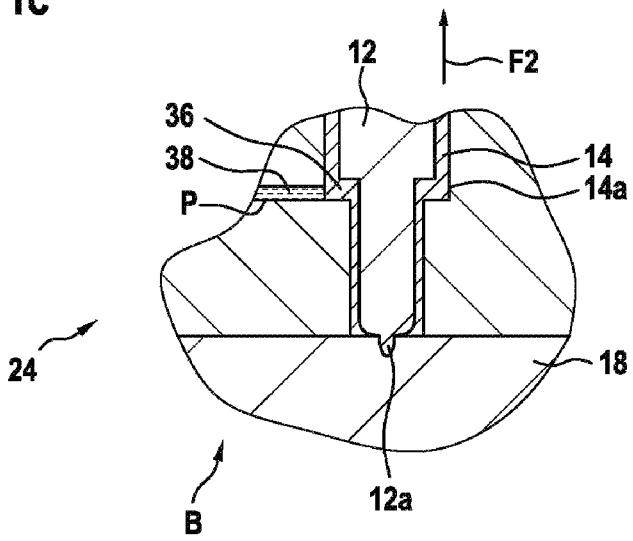
FIG. 1C shows an enlarged cross-sectional view of portion B shown in FIG. 1A of the fuel injection system according to the various exemplary embodiments of the invention.

FIG. 1C shows an enlarged cross-sectional view of portion B shown in FIG. 1A of the fuel injection system according to the various exemplary embodiments of the invention.

The adjusting device 24 includes a first flexible gasket 36 disposed at an axial end portion 13*a* of the injector bore 14 adjacent to the combustion chamber 18.

The first flexible gasket 36 fluidically communicates a fluid supply 38. The first flexible gasket 36 is moreover configured such that a thickness of the first flexible gasket 36 in the axial direction of the injector nozzle 12 is adjustable by adjusting a fluid pressure P supplied to the first flexible gasket 36 by the fluid supply 38.

The first flexible gasket 36 is thus configured to vary the second axial force F2 applied to the injector nozzle 12, wherein the axial position of the injector nozzle 12 in the injector bore 14 is adjustable by the first flexible gasket 36 to the predetermined position within the range of predetermined positions as a function of the thickness of the first flexible gasket 36.

Figure 2:
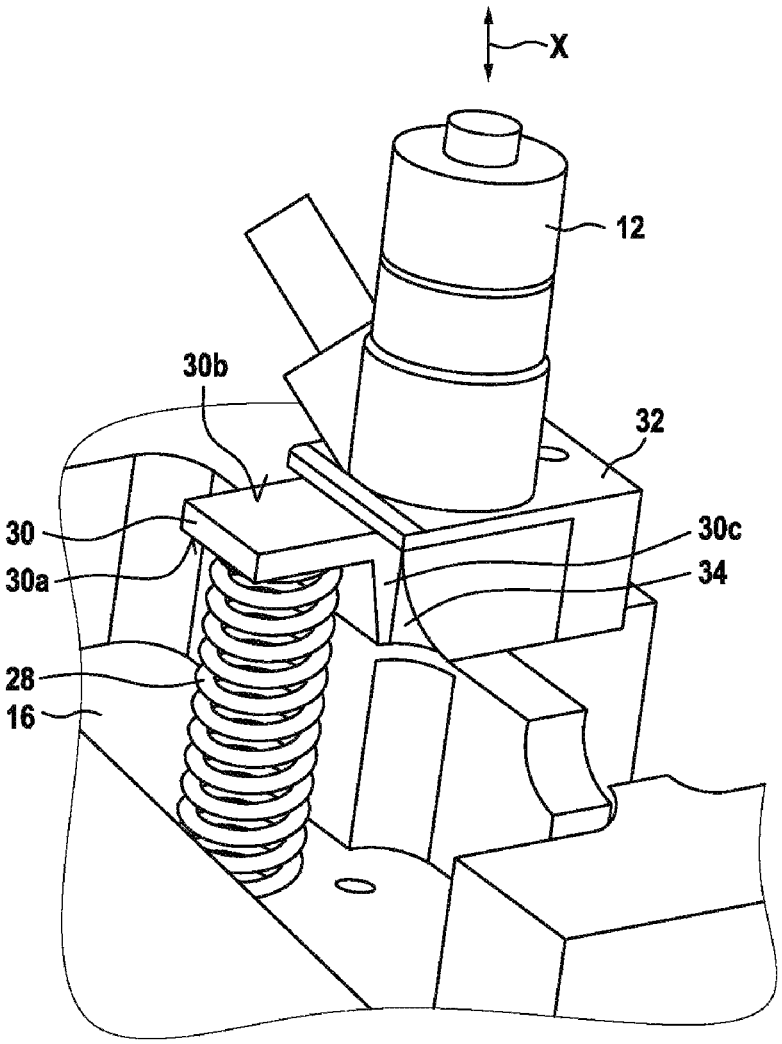
FIG. 2 shows a schematic view of the fuel injection system according to the various exemplary embodiments of the invention.

FIG. 2 shows a schematic view of the fuel injection system according to the various exemplary embodiments of the invention.

The spring element 28 is formed by a helical spring. Alternatively, other types of springs having other geometries can be configured in place of the helical spring.

The rocker lever 30 has a substantially plate-like shape and is disposed in a plane substantially perpendicularly to the axial direction X of the injector nozzle 12.

The injector mounting element 32 likewise is disposed to be substantially perpendicular to the axial direction X of the injector nozzle 12, wherein the injector mounting element 32 completely encloses the injector nozzle 12 and is supported on a surface of the cylinder head 16.

Figure 3:
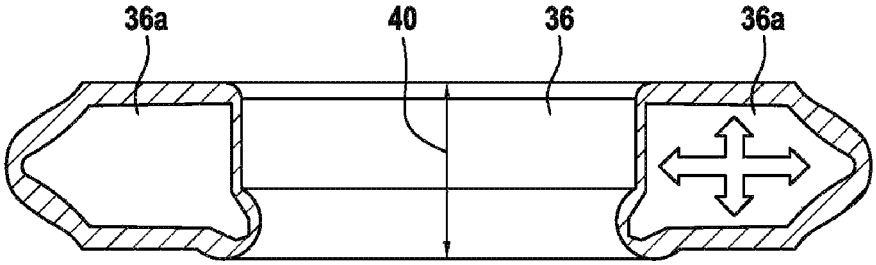
FIG. 3 shows a cross-sectional view of a flexible gasket of the fuel injection system according to the various exemplary embodiments of the invention.

FIG. 3 shows a cross-sectional view of a flexible gasket of the fuel injection system according to the various exemplary embodiments of the invention.

The first flexible gasket 36 is formed by a metal mesh that has a hollow inside volume which is filled with fluid. The first flexible gasket 36 has an opening (not shown in FIG. 3) such that a fluid pressure of the fluid inside the first flexible gasket 36 can be varied by varying a fluid pressure P supplied by the fluid supply.

Alternatively, instead of the first flexible gasket 36, a bellows can be provided as a spring element. The bellows may or may not be connected to a fluid supply.

A variation of fluid pressure of the fluid inside the first flexible gasket 36 can thus change the thickness 40 of the first flexible gasket 36. A high fluid pressure thus results in an increased thickness 40, wherein a fluid pressure results in the fluid filled into the first flexible gasket 36 to be moved into an expansion chamber 36*a* disposed at respective side portions of the first flexible gasket 36 when the injector nozzle (not shown in FIG. 3) exerts a pressure on an upper surface of the first flexible gasket 36.

Figure 4A:
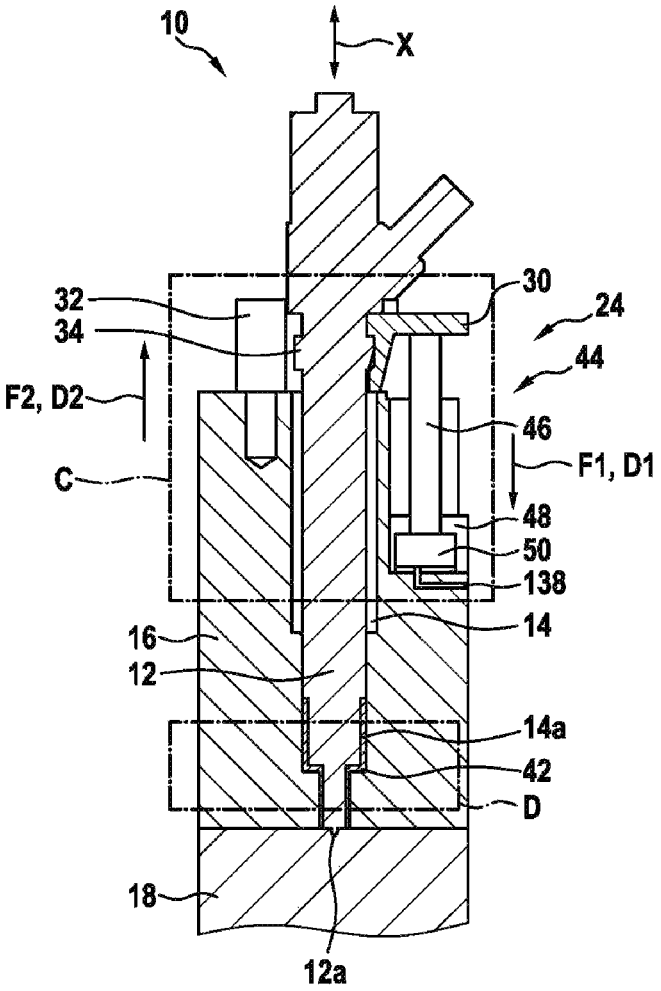
FIG. 4A shows a cross-sectional view of the fuel injection system according to various exemplary embodiments of the invention.

FIG. 4A shows a cross-sectional view of the fuel injection system according to various exemplary embodiments of the invention.

Instead of the spring element used in the various exemplary embodiments, according to the various exemplary embodiments of the invention a piston arrangement 44 is employed. The piston arrangement 44 is connected to the injector nozzle 12 such that a piston movement of the piston arrangement 44 is converted into the first axial force F1 directed in the first axial direction D1 applied to the injector nozzle 12.

The tensioner device 22 includes a second flexible gasket 42 disposed at an axial end portion 14*a* of the injector bore 14 adjacent to the combustion chamber 18. The second flexible gasket 42 is filled with a fluid, wherein the second flexible gasket 42 is configured to apply the second axial force F2 to the injector nozzle 12 directed in a second axial direction D2.

Figure 4B:
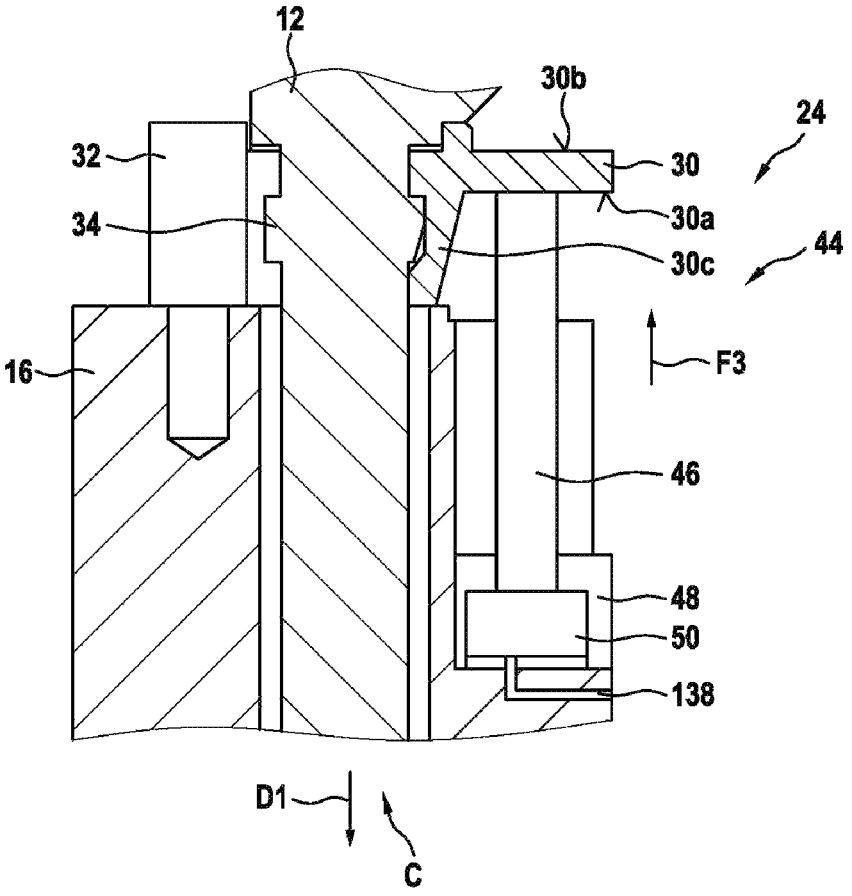
FIG. 4B shows an enlarged cross-sectional view of portion C shown in FIG. 4A of the fuel injection system according to the various exemplary embodiments of the invention.

FIG. 4B shows an enlarged cross-sectional view of portion C shown in FIG. 4A of the fuel injection system according to the various exemplary embodiments of the invention.

The piston arrangement 44 of the adjusting device 24 includes a piston rod 46, a first axial end portion 46*a* which is connected to a piston 48 disposed in a chamber 50 which fluidically communicates a fluid supply 138.

A second axial end portion 46*b* of the piston rod 46 abuts a rocker lever 30. The piston rod 46 is disposed substantially in parallel to the injector nozzle 12. Alternatively, the piston arrangement 44 can be disposed in any other suitable angle in relation to the injector nozzle 12.

The piston rod 46 is configured to apply a force F3 to a first side 30*a* of the rocker lever 30. The rocker lever 30 is being held between an injector mounting element 32 disposed at a second side 30*b* of the rocker lever 30. The injector mounting element 32 is mounted to the cylinder head 16. An injector clamping element 34 is disposed at the first side 30*a* of the rocker lever 30 adjacent to the piston rod 46.

The injector clamping element 34 is securely clamped to the injector nozzle 12 at a predetermined axial position such that movement of the injector clamping element 34 results in a movement of injector nozzle 12.

The piston rod 46 is configured to tilt the rocker lever 30 such that the rocker lever 30 applies an axial force to the injector clamping element 34 in the first axial direction D1. The injector clamping element 34 is thus configured to adjust an axial position of the injector nozzle 12 in the injector bore 14.

By actuation of the injector nozzle 12 via the piston rod 46, a fluid pressure presses the injector nozzle 12 deeper into the second flexible gasket 42. The second flexible gasket 42 thus deforms in a determined way keeping a volume inside the second flexible gasket 42 substantially constant. Therefore the fluid pressure in the second flexible gasket 42 is also substantially constant.

Figure 4C:
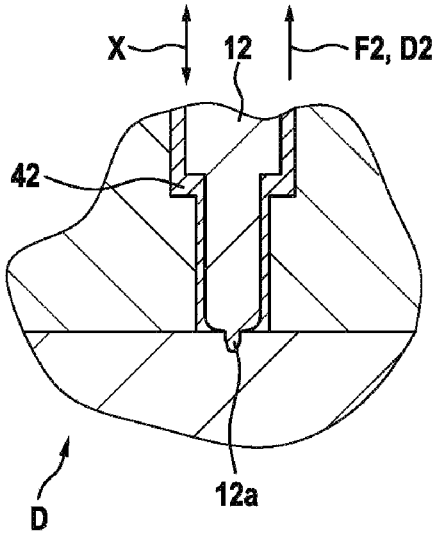
FIG. 4C shows an enlarged cross-sectional view of portion D shown in FIG. 4A of the fuel injection system according to the various exemplary embodiments of the invention.

FIG. 4C shows an enlarged cross-sectional view of portion D shown in FIG. 4A of the fuel injection system according to the various exemplary embodiments of the invention.

The second flexible gasket 42 is configured to apply the second axial force F2 in the second axial direction D2 as a function of a thickness of the second flexible gasket 42 in the axial direction X of the injector nozzle 12.

In the present various exemplary embodiments, the second flexible gasket thus does not require to be fluidically communicated with a fluid supply since it serves to tension the injector nozzle against the force applied by the piston arrangement to the injector nozzle, i.e. it is configured to provide a counterforce to the force generated by the piston arrangement, thus effectively tensioning, i.e. preloading the injector nozzle.

Figure 5:
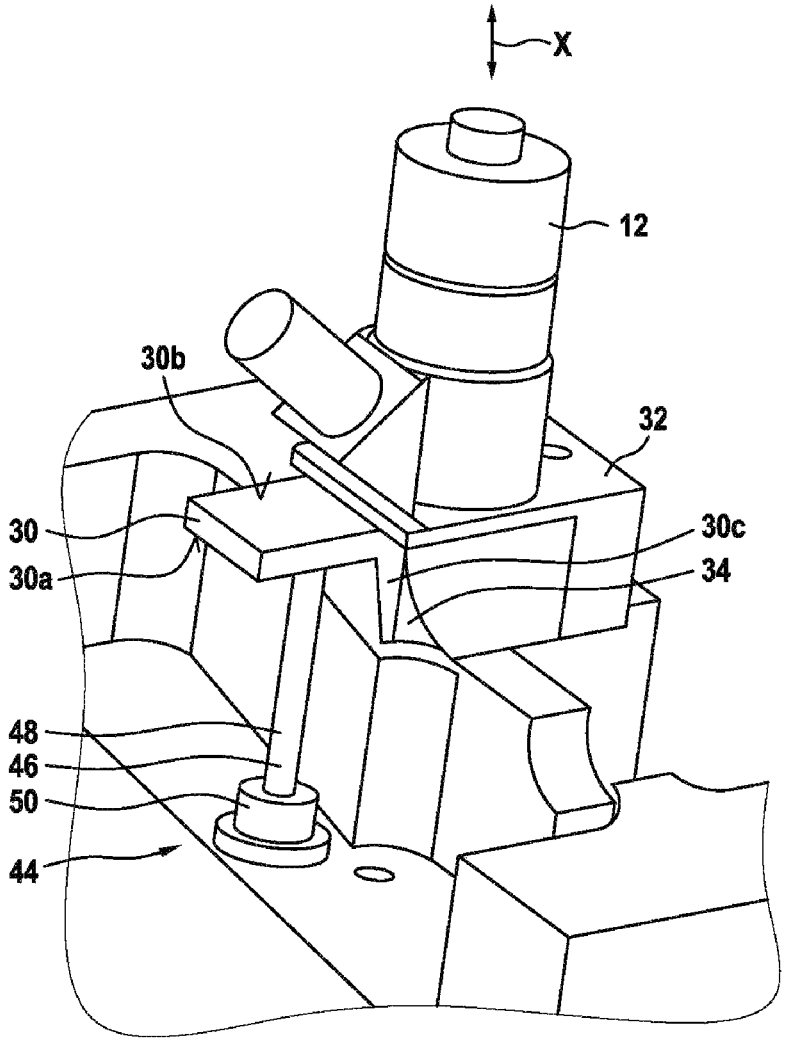
FIG. 5 shows a schematic view of the fuel injection system according to the various exemplary embodiments of the invention.

FIG. 5 shows a schematic view of the fuel injection system according to the various exemplary embodiments of the invention.

The piston rod 46 of the piston arrangement 44 is formed to have a predetermined length in accordance to specific package requirements. The length of the piston rod 46 may alternatively be different to what is shown according to the various exemplary embodiments.

The rocker lever 30 has a substantially plate-like shape and is disposed in a plane substantially perpendicularly to the axial direction X of the injector nozzle 12.

The injector mounting element 32 likewise is disposed to be substantially perpendicular to the axial direction X of the injector nozzle 12, wherein the injector mounting element 32 completely encloses the injector nozzle 12 and is supported on a surface of the cylinder head 16.

Figure 6:
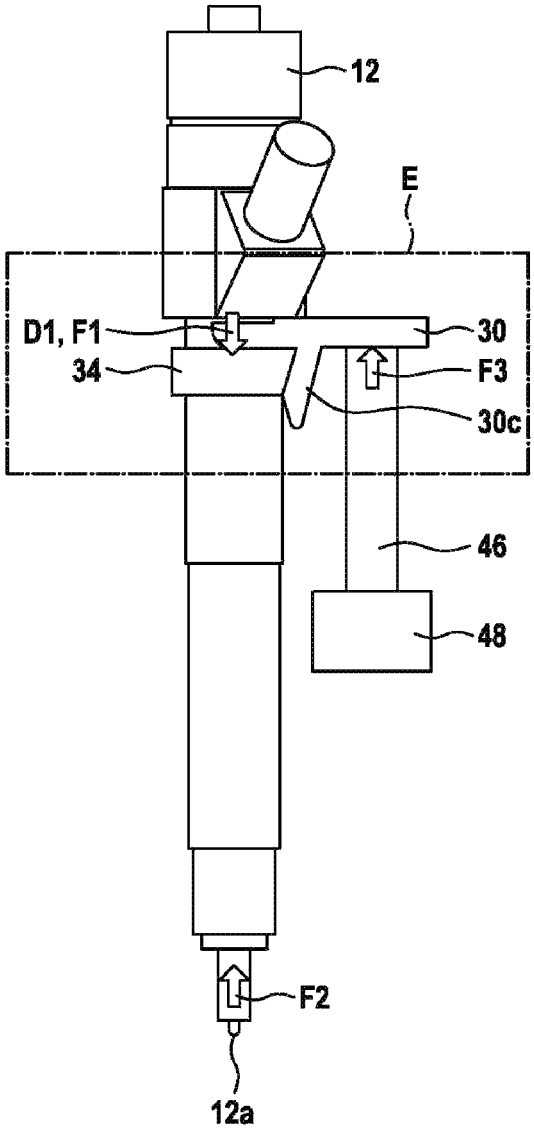
FIG. 6 shows a schematic view of the fuel injection system according to the various exemplary embodiments of the invention.

FIG. 6 shows a schematic view of the fuel injection system according to the various exemplary embodiments of the invention.

The rocker lever 30 according to the various exemplary embodiments partially surrounds the injector nozzle, i.e. is formed in a semi-circular shape in a top view such that it surrounds at least half of the circumference of the injector nozzle 12.

By the present design, the rocker lever 30 is situated on top of the injector clamping element, i.e. sits on an upper surface of the injector clamping element 34, thus optimally transmitting the axial force generated by the piston arrangement 44 in the first axial direction D1.

Figure 7:
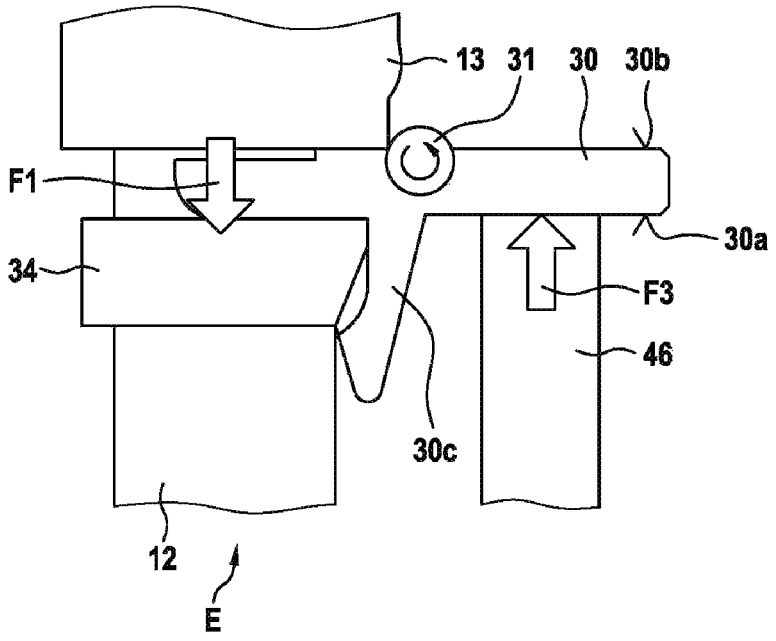
FIG. 7 shows an enlarged schematic view of portion E shown in FIG. 6 of the fuel injection system according to the various exemplary embodiments of the invention.

FIG. 7 shows an enlarged schematic view of portion E shown in FIG. 6 of the fuel injection system according to the various exemplary embodiments of the invention.

The rocker lever 30 has a pivot point 31 which is disposed substantially at a midpoint of the rocker lever 30. According to the exemplary embodiment of the present invention, the rocker lever 30 at its second side 30*b* is not supported by the injector mounting element but abuts a radial protrusion 13 of injector nozzle 12.

In the present way, the rocker lever 30 can effectively convert the force F3 generated by the piston arrangement 44 into the first axial force F1 directed in the first axial direction D1, thus generating a downward movement of the injector nozzle 12 by moving the injector clamping element 34.

The rocker lever 30 further includes a restriction element 30*c* which extends from the first side 30*a* of the rocker lever 30 in the first axial direction D1 and is at least partially bent towards the injector nozzle 12 at a predetermined degree to an axial direction X of the injector nozzle 12. The restriction element 30*c* is configured as a lower stop to limit a movement of the injection nozzle 12 in the injector bore 14.

Figure 8:
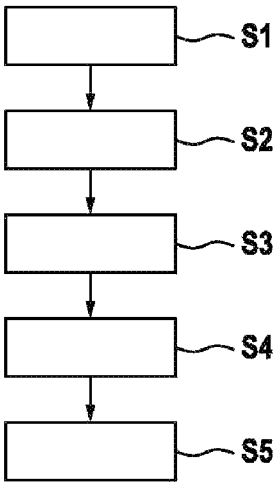
FIG. 8 shows a flow diagram of a method of operating the fuel injection system according to the exemplary embodiments of the invention.

FIG. 8 shows a flow diagram of a method of operating the fuel injection system for an internal combustion engine of a vehicle according to the exemplary embodiments of the invention.

The method includes providing S1 an injector nozzle mounted in an injector bore formed in a cylinder head of the internal combustion engine, wherein a tip portion of the injector nozzle protrudes into a combustion chamber and providing S2 a positioning system for adjusting an axial position of the injector nozzle in the injector bore.

The method further includes applying S3 a first axial force to the injector nozzle directed in a first axial direction by a tensioner device.

The method moreover includes applying S4 a second axial force to the injector nozzle directed in a second axial direction by an adjusting device, the second axial force being directed in an opposite direction than the first axial force.

The method additionally includes varying S5 the second axial force applied to the injector nozzle, wherein the axial position of the injector nozzle in the injector bore is adjusted to a predetermined position within a range of predetermined positions.

The method furthermore includes that the first axial force applied to the injector nozzle by the tensioner device and the second axial force applied to the injector nozzle by the adjusting device are substantially equal in magnitude.

Figure 9:
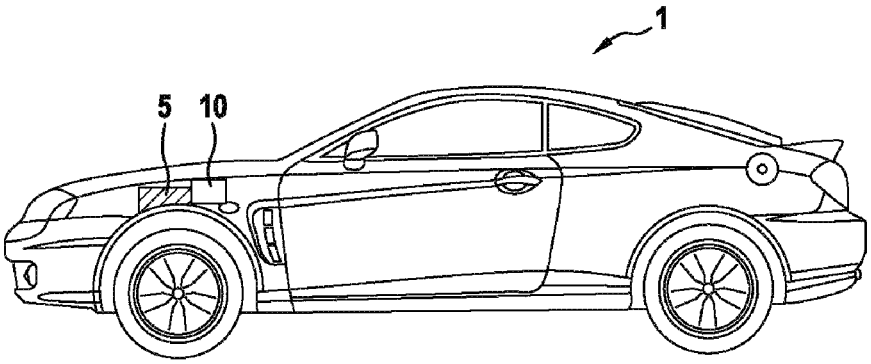
FIG. 9 shows a vehicle according to the exemplary embodiments of the invention.

FIG. 9 shows a vehicle according to the exemplary embodiments of the invention.

The vehicle 1 includes an internal combustion engine 5 and a fuel injection system 10 according to the first and various exemplary embodiments of the present invention.

Although the afore-mentioned fuel injection system has been described in connection to vehicles, a person skilled in the art is aware of the fact that the herein described fuel injection system can of course be applied to other objects that comprise internal combustion engines.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel injection system for an engine of a vehicle, including:

an injector nozzle mounted in an injector bore formed in a cylinder head of the engine, wherein a tip portion of the injector nozzle is protrudingly formed into a combustion chamber of the engine; and a positioning system configured to adjust an axial position of the injector nozzle in the injector bore, wherein the positioning system includes a tensioner device configured to apply a first axial force to the injector nozzle directed in a first axial direction thereof, and wherein the positioning system includes an adjusting device configured to apply a second axial force to the injector nozzle, the second axial force being directed in an opposite direction to the first axial force, the adjusting device is configured to vary the second axial force applied to the injector nozzle, and the axial position of the injector nozzle in the injector bore is adjustable to a predetermined position within a range of predetermined positions.

2. The fuel injection system according to claim 1, wherein the first axial force applied to the injector nozzle by the tensioner device and the second axial force applied to the injector nozzle by the adjusting device are equal in magnitude.

3. The fuel injection system according to claim 1, wherein a distance of the tip portion of the injector nozzle protruding into the combustion chamber is adjustable to a predetermined position within the range of the predetermined positions by adjusting the axial position of the injector nozzle in the injector bore.

4. The fuel injection system according to claim 1, wherein the tensioner device includes an elastic member which is connected to the injector nozzle such that an elastic force of the elastic member is converted into the first axial force directed in the first axial direction applied to the injector nozzle.

5. The fuel injection system according to claim 4, wherein the tensioner device further includes a rocker lever, an injector mounting element and an injector clamping element, and wherein the elastic member is disposed in parallel to the injector nozzle and applies an elastic force to a first side of the rocker lever, the rocker lever being held between the injector mounting element disposed at a second side of the rocker lever, the injector mounting element being mounted to the cylinder head, and the injector clamping element disposed at the first side of the rocker lever adjacent to the elastic member, the injector clamping element being clamped to the injector nozzle at a predetermined axial position.

6. The fuel injection system according to claim 5, wherein the elastic member is configured to tilt the rocker lever such that the rocker lever applies an axial force to the injector clamping element, the injector clamping element being configured to adjust an axial position of the injector nozzle in the injector bore.

7. The fuel injection system according to claim 1, wherein the adjusting device includes a first flexible gasket disposed at an axial end portion of the injector bore adjacent to the combustion chamber, wherein the first flexible gasket fluidically communicates a fluid supply, and wherein the first flexible gasket is configured such that a thickness of the first flexible gasket in an axial direction of the injector nozzle is adjustable by adjusting a fluid pressure supplied to the first flexible gasket.

8. The fuel injection system according to claim 7, wherein the first flexible gasket is configured to vary the second axial force applied to the injector nozzle, wherein the axial position of the injector nozzle in the injector bore is adjustable by the first flexible gasket to the predetermined position within the range of the predetermined positions as a function of a thickness of the first flexible gasket.

9. The fuel injection system according to claim 1, wherein the tensioner device includes a second flexible gasket disposed at an axial end portion of the injector bore adjacent to the combustion chamber, wherein the second flexible gasket is filled with a fluid, and wherein the second flexible gasket is configured to apply the second axial force to the injector nozzle directed in a second axial direction thereof.

10. The fuel injection system according to claim 9, wherein the second flexible gasket is configured to apply the second axial force in the second axial direction as a function of a thickness of the second flexible gasket in the axial direction of the injector nozzle.

11. The fuel injection system according to claim 1, wherein the adjusting device includes a piston arrangement which is connected to the injector nozzle such that a piston movement of the piston arrangement is converted into the first axial force directed in the first axial direction applied to the injector nozzle.

12. The fuel injection system according to claim 11, wherein the piston arrangement of the adjusting device includes a piston rod, a first axial end portion of which is connected to a piston disposed in a chamber which fluidically communicates a fluid supply, and a second axial end portion of which abuts a rocker lever, wherein the piston rod is disposed in parallel to the injector nozzle and is configured to apply a force to a first side of the rocker lever, the rocker lever being held between an injector mounting element disposed at a second side of the rocker lever, the injector mounting element being mounted to the cylinder head, and an injector clamping element disposed at the first side of the rocker lever adjacent to the piston rod, the injector clamping element being clamped to the injector nozzle at a predetermined axial position.

13. The fuel injection system according to claim 12, wherein the piston rod is configured to tilt the rocker lever such that the rocker lever applies an axial force to the injector clamping element, the injector clamping element being configured to adjust an axial position of the injector nozzle in the injector bore.

14. The fuel injection system according to claim 1, characterized in that the adjusting device is configured to continuously adjust the injector nozzle in the injector bore as a function of predetermined operating parameters of the engine including at least one of an engine speed, an engine torque and a fuel injection quantity.

15. A method of operating a fuel injection system for an engine of a vehicle, the method including steps of:

providing an injector nozzle mounted in an injector bore formed in a cylinder head of the engine, wherein a tip portion of the injector nozzle is protrudingly formed into a combustion chamber of the engine and providing a positioning system for adjusting an axial position of the injector nozzle in the injector bore;

applying a first axial force to the injector nozzle directed in a first axial direction thereof by a tensioner device; and applying a second axial force to the injector nozzle directed in a second axial direction thereof by an adjusting device, the second axial force being directed in an opposite direction to the first axial force; and varying the second axial force applied to the injector nozzle, wherein the axial position of the injector nozzle in the injector bore is adjusted to a predetermined position within a range of predetermined positions.

16. The vehicle having the engine and the fuel injection system according to claim 1.

17. The vehicle having the engine and the fuel injection system according to claim 15.

* * * * *